US009333643B2

(12) United States Patent
Brallier

(10) Patent No.: US 9,333,643 B2
(45) Date of Patent: May 10, 2016

(54) MULTI-OFFSET SCRIBE TOOL

(71) Applicant: David Edward Brallier, Los Gatos, CA (US)

(72) Inventor: David Edward Brallier, Los Gatos, CA (US)

( * ) Notice: Subject to any disclaimer, the term of this patent is extended or adjusted under 35 U.S.C. 154(b) by 113 days.

(21) Appl. No.: 14/219,832

(22) Filed: Mar. 19, 2014

(65) Prior Publication Data

US 2014/0290078 A1 Oct. 2, 2014

Related U.S. Application Data

(60) Provisional application No. 61/805,287, filed on Mar. 26, 2013, provisional application No. 61/826,555, filed on May 23, 2013, provisional application No. 61/887,536, filed on Oct. 7, 2013.

(51) Int. Cl.
*B43L 13/02* (2006.01)
*B25H 7/04* (2006.01)

(52) U.S. Cl.
CPC ..... *B25H 7/045* (2013.01)

(58) Field of Classification Search
CPC ..... B25H 7/045
USPC ..... 33/24.1, 32.1, 32.2, 32.3, 41.6, 42, 44; 30/151, 152, 162, 299, 304, 339
See application file for complete search history.

(56) References Cited

U.S. PATENT DOCUMENTS 2,594,932 A * 4/1952 Judelson ..... D06H 7/04 30/304
4,517,741 A * 5/1985 Castelluzzo ..... B26B 5/001 221/212
4,578,865 A * 4/1986 Keller ..... B26B 5/008 30/162
5,012,581 A * 5/1991 Fletcher ..... B26B 5/003 30/151
5,337,481 A * 8/1994 Mears ..... B26B 5/008 30/162
5,533,269 A * 7/1996 Pickens ..... A21C 15/04 30/293
6,678,958 B1 * 1/2004 Budrow ..... B26B 5/001 30/125
6,941,605 B2 9/2005 McCreesh
7,162,805 B2 1/2007 Vick
7,231,720 B2 6/2007 Allen
7,240,435 B1 7/2007 Dowdakin
7,254,855 B2 8/2007 McCreesh
7,392,589 B2 7/2008 Friegang
7,467,471 B1 12/2008 Sutter
7,690,124 B1 * 4/2010 Henry ..... G01C 15/004 324/67
7,797,842 B2 9/2010 Fernandes
8,065,811 B2 11/2011 Harrison
8,117,758 B1 2/2012 Crochet
8,117,760 B1 2/2012 Revell
2004/0055168 A1 3/2004 Allen
2005/0034244 A1 2/2005 McCreesh
2006/0101582 A1 5/2006 McCreesh
2007/0033886 A1 2/2007 Friegang (Continued)

FOREIGN PATENT DOCUMENTS

EP 1654094 B1 12/2010
WO WO2005018880 A2 3/2005

(Continued)

*Primary Examiner* — G. Bradley Bennett
(74) *Attorney, Agent, or Firm* — Kaplan IP Law, P.C.; Jonathan M. Kaplan

(57) ABSTRACT

The inventions disclosed herein relate to multi-offset scribe tools and uses thereof for finish carpentry, precision woodworking, and any other crafts or manufacturing processes requiring one to connect two objects via surfaces that are not precisely matched.

26 Claims, 6 Drawing Sheets

(56) References Cited

U.S. PATENT DOCUMENTS

| | | | | |
|---|---|---|---|---|
| 2007/0277387 | A1 | 12/2007 | Morrell | |
| 2008/0313912 | A1 | 12/2008 | Sutter | |
| 2012/0017441 | A1* | 1/2012 | Kalajyan | B26B 5/001 30/152 |
| 2012/0124847 | A1 | 5/2012 | Chamberlain | |
| 2012/0311877 | A1 | 12/2012 | Manohar | |
| 2013/0051951 | A1 | 2/2013 | Friegang | |
| 2013/0160308 | A1 | 6/2013 | O'Hare | |
| 2015/0209968 | A1* | 7/2015 | Wu | B26B 5/002 30/162 |
| 2015/0239135 | A1* | 8/2015 | Chu | B26B 1/08 30/162 |

FOREIGN PATENT DOCUMENTS

| | | | |
|---|---|---|---|
| WO | WO2008149515 | A1 | 12/2008 |
| WO | WO2009093619 | A1 | 7/2009 |
| WO | WO2011011819 | A1 | 2/2011 |
| WO | WO2012022968 | A1 | 2/2012 |
| WO | WO2012069933 | A1 | 5/2012 |

* cited by examiner

MULTI-OFFSET SCRIBE TOOL

FIELD OF THE INVENTION

The inventions disclosed herein relate to multi-offset scribe tools and uses thereof for finish carpentry, precision woodworking, and any other crafts or manufacturing processes requiring one to connect two objects via surfaces that are not precisely matched.

BACKGROUND

Scribing is an important technique for installing cabinets, baseboards, shelves, countertops, mouldings and the like against walls or floors having imprecisely matched surfaces. It is the act of tracing an imperfect surface onto material so that the material will fit tightly to the surface once material is removed to the scribed line. An example of where scribing is done would be on baseboard where it is scribed to tightly fit to the floor or cabinets where they are scribed to tightly fit to the wall. Construction and woodworking materials used for domestic and industrial purposes are often fitted together as well as to existing surfaces such as floors and walls. The junction between the materials or between the materials and the surfaces often do not precisely match and need to be adjusted for better aesthetics or proper function. Carpenters, craftsman, woodworkers, or other material installers may overcome the mismatches in the surfaces to be joined by transcribing the profile of a reference surface of onto a target surface of an object using a scribe tool. The profile of a reference surface is often transcribed onto a target surface for fitting to the reference surface. After a scribe line is marked, the material is then cut, planed, or trimmed to match the transcribed profile for a tight fit.

SUMMARY OF THE INVENTION

The invention relates to a multi-offset scribe tool for marking or cutting a scribe onto items such as baseboards, cabinets, or other commercial or industrial materials. In particular, the inventions disclosed herein provide multi-offset scribe tools that hold marking structures such as blades, pens, lead, graphite, and the like.

In one embodiment, the invention comprises a multiple offset scribe tool comprising a marking structure, a body having a first flat surface and a second flat surface on opposite sides of the body, a first end surface, and a first opening for housing the marking structure in either a use or a safety position. In this embodiment, the opening is positioned on the end surface between the first and second flat surfaces to enable the marking structure to extend from the end surface when in the use position. The opening is offset a first predetermined distance from a first plane formed by the first flat surface and offset a second predetermined distance from a second plane formed by the second flat surface. Thus, the scribe tool is enabled to scribe a line on a target surface of the first predetermined distance from a reference surface when the first flat surface is positioned on the reference surface and enabled to scribe a line on the target surface of the second predetermined distance from the reference surface when the second flat surface is positioned on the reference surface.

In a preferred embodiment, the scribe tool further comprises a second opening on the end surface that is offset a third predetermined distance from the plane formed by the first flat surface and offset a fourth predetermined distance from the plane formed by the second flat surface. In other preferred embodiments, the scribe tool comprises a plurality of additional openings on the end surface wherein the additional openings are offset additional predetermined distances from the planes formed by the first and second flat surfaces. In a more preferred embodiment, the scribe tool comprises a plurality of middle layers within the body of the scribe tool that define the plurality of predefined distance to the planes formed by the flat surfaces. In a most preferred embodiment, the scribe tool comprises five layers having two flat surfaces and three middle layers and having four openings. In another preferred embodiment the first and second flat surfaces of the scribe tool have different thicknesses.

In another embodiment, the body of the scribe tool is solid. In preferred embodiments, the solid body is made from a liquid molding process or shaped from a solid material.

In another embodiment, the scribe tool further comprises a second end surface having additional openings that are offset additional predetermined distances from the planes formed by the first and second flat surfaces.

In another embodiment, the scribe tool comprises offsets of English measure increments. Another term in the art for English measure is standard measure. These terms are often used interchangeably. In a preferred embodiment, one or more of the offsets are ⅛ inch increments minus the thickness of the marking structure. In another preferred embodiment, one or more of the offsets are 1/16 inch increments minus the thickness of the marking structure.

In another embodiment, the scribe tool comprises offsets of metric measure increments. In a preferred embodiment, the scribe tool of claim 3, wherein one or more of the offsets are 2 mm increments minus the thickness of the marking structure. In another preferred embodiment one or more of the offsets are 3 mm increments minus the thickness of the marking structure. In another preferred embodiment, one or more of the offsets are 4 mm increments minus the thickness of the marking structure. In another preferred embodiment, one or more of the offsets are 5 mm increments minus the thickness of the marking structure. In another preferred embodiment, the scribe tool comprises a first group of offsets having English measure increments and a second group of offsets having metric measure increments.

In another embodiment the approximate shape of the scribe tool's body is a polygon. In a preferred embodiment, the polygon is selected from the group consisting of a triangle, quadrilateral, pentagon, hexagon, septagon, octagon, nonagon, decagon, and a dodecagon. In another embodiment, the approximate shape of the scribe tool's body is round or ovoid. In another embodiment, the approximate shape of the scribe tool's body comprises both angled and curved lines. In another embodiment, one or more sides of the scribe tool's body are ribbed.

In another embodiment, one or more of the flat surfaces comprise a material selected from the group consisting of wood, plastic, acrylic, nylon, nylon blend, polyurethane, carbon fiber, metal, anodized metal, cellulose acetate, cellulose propionate, monel, beryllium, flexon, and polycarbonate. In another embodiment, one or more middle layers comprise a material selected from the group consisting of a hard metal, a semi-hard metal, acrylic, nylon, nylon blend, polyurethane, carbon fiber, zinc, monel, beryllium, flexon, polycarbonate, steel, stainless steel, brass, iron, copper, aluminum, aluminum alloy, titanium, titanium alloy, nickel, nickel alloy, lead, gold, gold alloy, silver, and silver alloy. In another embodiment, the marking structure is a blade comprised of a material selected from the group consisting of stainless steel, tool steel, alloy steel, titanium alloys, ceramics, obsidian, plastics, carbonized steel, iron, nickel, cobalt, and magnetic alloys.

In another embodiment, the scribe tool comprises a magnet embedded within the body.

In another embodiment, the scribe tool comprises a marking structure selected from the group consisting of blades, pens, pencils, lead, graphite, markers, crayons, chalk, charcoal, and paint.

In another embodiment, the marking structure is put in the safety position by reversing it into the opening, folding it into the body, or retracting it into the body.

DETAILED DESCRIPTION OF THE INVENTION

Figure 1:
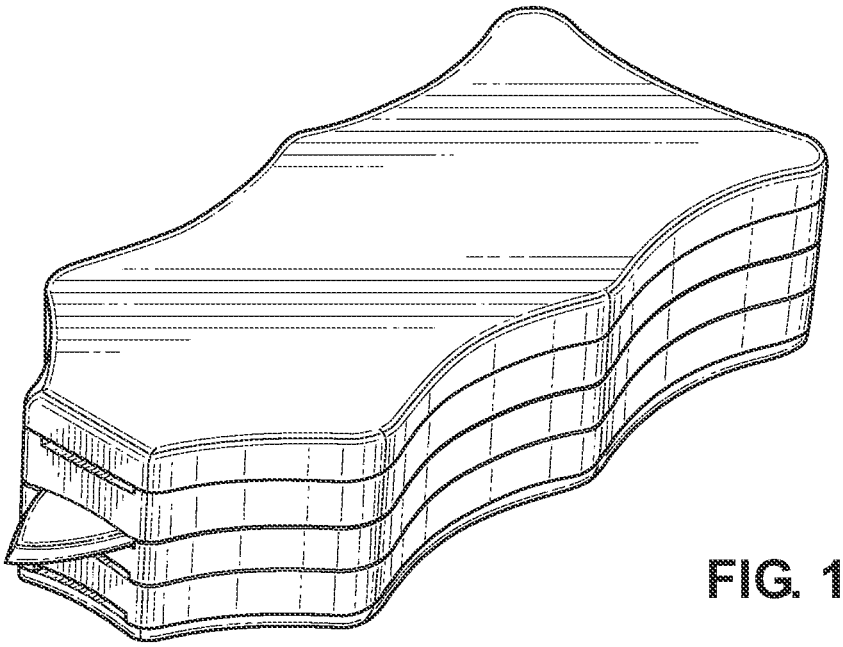
FIG. 1. A preferred embodiment of the multi-offset scribe tool with ribbed sides for an increasingly-secure grip. This embodiment utilizes five layers and four blade openings.
Figure 2:
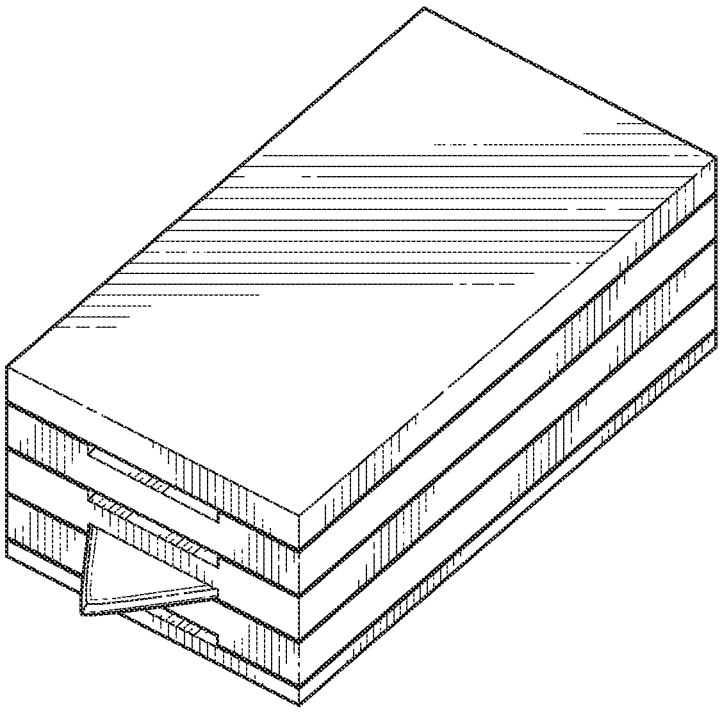
FIG. 2. A multi-offset scribe tool with a square-shaped body. The embodiment depicted in this figure utilizes five layers and four blade openings.
Figure 3:
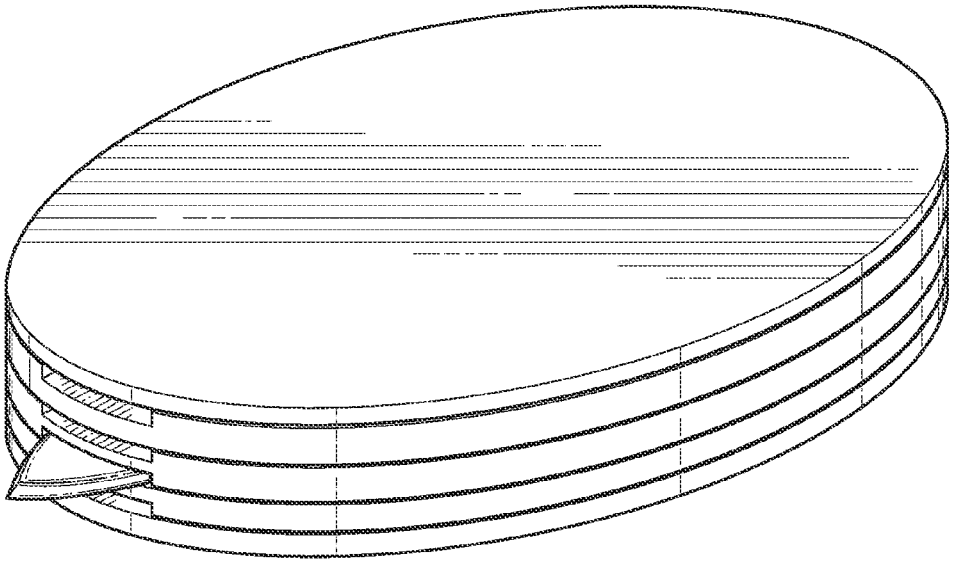
FIG. 3. A multi-offset scribe tool with an ovoid-shaped body. The embodiment depicted in this figure utilizes five layers and four blade openings.
Figure 4:
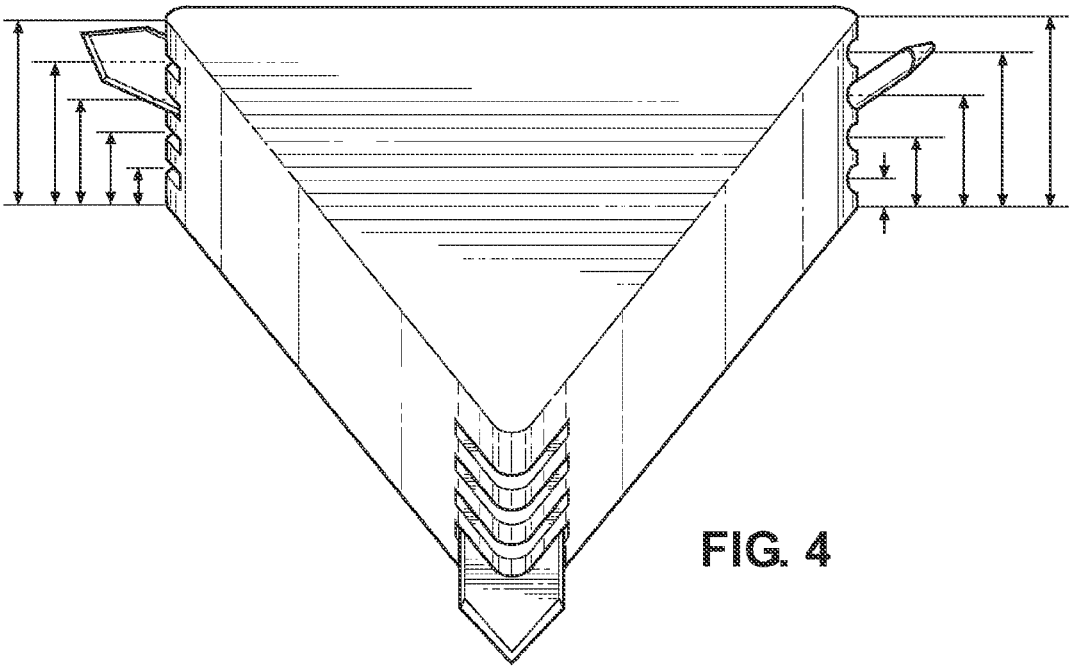
FIG. 4. A multi-offset scribe tool with a triangular-shaped body. This figure provides a number of alternative embodiments and is provided for exemplary purposes. Any of the alternative embodiments may be individually used in the scribe tools of the invention. This figure depicts a solid body with both blade and non-blade marking structures. Additionally, this embodiment utilizes mixed measures comprising English (⅛ inch) and metric (3 mm) increments.

Scribing is an important technique for carpenters, woodworkers, and other craftsman. For instance, carpenters installing architectural woodwork often have to install straight pieces onto walls and floors that are not perfectly flat, plumb, or level. Achieving a seamless, accurate fit can be a time consuming and difficult task. The inventions described herein provide multiple offset scribe devices or tools for the precise installation of cabinets, countertops, mouldings, built-in woodwork, and the like. They use blades, pens, pencils, or other marking structures to score distinct lines for accurate and easy removal of material. They are simple to use, exact, compact, and ergonomic. They are effective for scoring or marking any material. Non-limiting examples of materials for scoring include wood, laminate, sheetrock, tiles, ceramics, bricks, stones, fabrics plastic, metal, or any other material to be scored and trimmed. The tools of the invention reduce chipping, and provide a clean, tight fit to a reference surface. In some embodiments, the blades or marking structures may be stored safely inside the tool when not in use. The top and bottom surfaces are flat for running along the surface to be scribed. In certain embodiments, the tools described herein fit in the palm a hand or in a pocket.

The scribe tools of the invention comprise a blade, pen, graphite, lead, or other marking structure, a body having a first flat surface and a second flat surface on opposite sides of the body, two side surfaces, two end surfaces, and one or a plurality of openings on one of the end surfaces. In some embodiments, the openings run through the length of the tool. Each opening is spaced from the other openings a predetermined distance and sized to enable the blade or marking structure to be selectively inserted into one of the openings. In some embodiments, the tools may further comprise one or more latches positioned in the body for removably retaining the blade or marking structure when it is inserted into any one of the openings. The openings are positioned with respect to each other and with respect to the first and second flat surfaces to enable the blade to be offset one of a set of first distances from the plane formed the first flat surface, and to enable the blade to be offset one of a set of second distances from the plane formed by the second flat surface. When the first flat surface of the body is positioned on a surface, the blade is enabled to generate a scribe line of one of a plurality of selectable distances from the surface. In a preferred embodiment, said one or plurality of openings are extended to accommodate folding of said blades or marking structures into the body of said scribe tool. In a more preferred embodiment, unfolded blades would lock in the open position.

One embodiment of the scribing devices comprises multiple layers. In a preferred embodiment, the devices comprise three layers: a first flat surface, a middle layer, and a second flat surface. In this embodiment, the three layers form two openings and up to four different offsets. In another preferred embodiment, the devices comprise four layers: a first flat surface, a first middle layer, a second middle layer, and a second flat surface. In this embodiment, the four layers form three openings and up to six different offsets. In another preferred embodiment, the devices comprise five layers: a first flat surface, a first middle layer, a second middle layer, a third middle layer, and a second flat surface. In this embodiment, the five layers form four openings and up to eight different offsets. In other embodiments, the number of openings and offsets similarly increases with each additional layer. In other embodiments, additional layers may add two openings to the tool, not one opening.

In some embodiments, two more middle layers provide the same offset increment. In these embodiments, the thicknesses of the middle layers define some of the desired offset spreads. In other embodiments, the layers are either the same thickness or different thicknesses or provide different offset increments. In some embodiments, the layers fit together using snap protrusions that fit into channels. They may have a recess for one or more blades, one or more hollows for magnets, or two or four holes for screws. In other embodiments, the layers are held together by rivets, solder, welding, glue, or other adhesives known in the art.

In some embodiments, the first and last (outer most) layers are the same as one another with the exception of their thickness. The result is a different offset depending on the flat surface that is facing down. Their thickness is determined by the desired offset array. In a preferred embodiment, a first offset is defined by a first flat surface and is ⅛ inch minus ½ the thickness of the blade; a second offset is defined by a second flat surface and is 1/16 inch minus ½ the thickness of the blade. In this preferred embodiment, each of the "internal" offsets are ⅛ inches apart, resulting in offsets of ⅛, ¼, ⅜, ½ inches etc. offsets from one flat surface and 1/16, 3/16, 5/16, and 7/16 inch etc. offsets from the other. The number of offsets increase similarly with each additional internal layer.

In another preferred embodiment, a first offset is defined by a first flat surface and is 2 mm minus ½ the thickness of the blade; a second offset is defined by a second flat surface and is 3 mm minus ½ the thickness of the blade. In this second preferred embodiment, each of the "internal" offsets are 2 mm apart, resulting in offsets of 2, 4, 6, and 8 mm etc. offsets from one flat surface and 3, 5, 7, and 9, etc. offsets from the other. The number of offsets increase similarly with each additional internal layer.

In another preferred embodiment, a first offset is defined by a first flat surface and is 3 mm minus ½ the thickness of the blade; a second offset is defined by a second flat surface and is 5 mm minus ½ the thickness of the blade. In this second preferred embodiment, each of the "internal" offsets are 3 mm apart, resulting in offsets of 3, 6, 9, and 12 mm etc. offsets from one flat surface and 5, 8, 11, and 14 mm etc. offsets from the other. The number of offsets increase similarly with each additional internal layer. As demonstrated, any combination of flat surfaces and internal offsets may be used.

In some embodiments, the device has 1, 2, 3, 4, 5, 6, 7, 8, 9, 10, 11, 12, 13, 14, 15, 16, 17, 18, 19, 20, 21-30, 31-40, 41-50, or more than 50 offsets. The offsets may be on one end surface or distributed across two or more end surfaces. In a preferred embodiment, the device has between 1 and 10 offsets. In a more preferred embodiment, the device has 8 offsets.

In another embodiment, the center layer has the same shape as the other layers. Its thickness is determined by the desired offsets spread minus 1 blade thickness. In a preferred embodiment, it has two blade openings the depth of each equal to the thickness of the blade. In another embodiment, no matter the desired offset spread (i.e. offset size or whether it is metric or English), the following mathematical representations can use to determine layer thickness (in this example, a five layer tool):

B is blade thickness and O is the desired offset spread:

Layer 1: $(\frac{1}{2}\times O)-(\frac{1}{2}\times B)$

Layer 2: O

Layer 3: O+B

Layer 4: O

Layer 5: $O-(\frac{1}{2}\times B)$

The mathematical representation above may also apply to non-blade marking structures where the scribe tool body is comprised of layers. B represents the thickness of the marking structure. With these representations, each opening will produce two possible offsets depending on the side on which the tool is placed. In a preferred embodiment, the desired offset spread is ⅛ inches and 5 layers will produce 1/16, 3/16, 5/16, and 7/16 inches from the first flat surface and ⅛, ¼, ⅜, and ½ inches from the second flat surface. In another preferred embodiment, six layers with ⅛ inch offsets will produce 1/16, 3/16, 5/16, 7/16, and 9/16 inches from the first flat surface and ⅛, ¼, ⅜, ½, and ⅝ inches from the second flat surface. In another preferred embodiment, the desired offset spread is 3 mm and 5 layers will produce 1.5 mm, 4.5 mm, 7.5 mm and 10.5 mm from the first flat surface and 3 mm, 6 mm, 9 mm and 12 mm from the second flat surface. In another preferred embodiment, the desired offset spread is 3 mm and 6 layers will produce 1.5 mm, 4.5 mm, 7.5 mm, 10.5 mm and 13.5 mm from the first flat surface and 3 mm, 6 mm, 9 mm, 12 mm and 15 mm from the second flat surface. In another embodiment, the scribe tool body is solid and the center of the marking structure provides the desired offset.

In another embodiment, the total offsets that result from a fully assembled tool may be represented as follows:

$T_x$ is the total offset, $O_x$ is the offset to the proximal side of the blade opening formed by the Outer layer, $M_x$ is the offset to the proximal side of the blade opening formed by the particular middle layer, B is the blade thickness First Flat Surface:

$$T_1=O_1+\tfrac{1}{2}B$$

$$T_2=O_1+M_1+\tfrac{1}{2}B$$

$$T_3=O_1+M_2+\tfrac{1}{2}B$$

$$T_4=O_1+M_3+\tfrac{1}{2}B$$

$$T_5=O_1+M_4+\tfrac{1}{2}B$$

Second Flat Surface:

$$T_6=O_2+\tfrac{1}{2}B$$

$$T_7=O_2+M_1+\tfrac{1}{2}B$$

$$T_8=O_2+M_2+\tfrac{1}{2}B$$

$$T_9=O_2+M_3+\tfrac{1}{2}B$$

$$T_{10}=O_2+M_4+\tfrac{1}{2}B$$

In this embodiment, the offsets generated by the outer and middle layers are independent. They may have the same offsets or different offsets. Thus, in this embodiment, the scribe tools of the invention may have customized offsets and offset intervals. This embodiment provides a high degree of customization. The mathematical representation above applies also to non-blade marking structures where B represents the thickness of the marking structure.

In another preferred embodiment, the scribe tools of the invention have two different end surfaces where on a first end the blade openings are offset using English (e.g. inch) measurements and on the second end the blade openings are offset using metric (e.g. millimeter) measurements. In another preferred embodiment, two or more sets of offsets are on one end surface.

One advantage of this layered component embodiment allows for accurate machining or manufacturing of the components prior to assembly. In some embodiments, magnets are placed between the layers during assembly. In a preferred embodiment, two magnets are used for increased security of the blades or marking structures. This preferred embodiment decreases the likelihood that the blades or marking structures fall out of the body accidentally.

In some embodiments, the layers are held together by "snap protrusions" that fit into "snap channels." Snap protrusions are linear protrusions that optionally follow the outside shape of the tool that snap or slot into snap channels present in the two more inward layers. In other embodiments, the scribe tools of the invention are not layered, but rather, of a solid-body construction. In preferred embodiment, the solid body may be manufactured with liquid molding or shaped from a solid material to produce the same results without the independent layers.

In one embodiment, a blade, pen, graphite, lead, or other marking structure, while in a "use" position, sticks out about ⅛, ¼, ⅜, ½, ⅝, ¾, ⅞, or 1 inch or more. In another embodiment, a blade, pen, graphite, lead, or other marking structure, while in a "use" position, sticks out about 1, 2, 3, 4, 5, 6, 7, 8, 9, 10, 11, 12, 13, 14, 15, 16, 17, 18, 19, 20, 21, 22, 23, 24, 25 millimeters or more. In a preferred embodiment, an extension is used to position a blade, pen, graphite, lead, or other marking structure farther from an end surface when the marking structure is in the "use" position. In other embodiments, the offsets may be increased by using trays, sleds, or other attachments that elevate the flat surfaces.

In some embodiments, the marking device protrudes far enough from the body of the tool to reach into 90 degree corners. In this embodiment, if a blade is used, it is bi-directional and protrudes far enough beyond the tool to reach into approximately 90 degree corners. In other embodiments, a front side offset extender attaches the marking structure to the body so that the structure is further extended from the body for getting into hard to reach scribing surfaces.

Ideally the scribe tools of the invention are shaped to optimize use. When sitting on a surface, the top and bottom of the tools are essentially flat so that they do not roll or tilt while being dragged or pulled along a surface. The ergonomics of hand tools are well known in the art. The sides may be about perpendicular to the top and bottom or form oblique angles to them. Alternatively, the sides may be rounded for increased comfort. In some embodiments, the shape of the scribe tool may be a polygon. In preferred embodiments, the polygon is approximately a triangle, quadrilateral, pentagon, hexagon, septagon, octagon, nonagon, decagon, dodecagon, or the like. In other preferred embodiments, the shape of the scribe tool may be round or ovoid. In other preferred embodiments, the shape of the scribe tool may encompass both angled and curved lines. In more preferred embodiments, the curved lines may be concave or convex. Alternative shape embodiments are shown in FIGS. 1-4.

In a most preferred embodiment, the sides of the shape may be ribbed for fingers to get a better hold as illustrated in FIG. 1. In this embodiment, the tool may take on a roughly triangular shape where the blade emerges from the front or more pointed side and the rest of the body widens enough to keep the tool stable while still being able to reach into 90 degree corners with the blade which protrudes from the tool about ¼ inch. The tool is made in layers, each of which has the same outline shape and size yet differ in thicknesses and recesses, cavities, and hollows. It is shaped in such a way that one's fingers can easily grasp, push and pull while it remains flat on a surface. It can reach into corners and is small enough to fit into a pocket.

The scribe tools of the invention may be made from one or more of a variety of different materials or a combination of materials such as wood, plastic or metal. Generally, the materials should be sturdy for construction, carpentry, and craftsman applications. The flat surfaces should generally be made of materials with a lower likelihood of marking or scratching surfaces on which they will slide.

In some embodiments, the flat surfaces may comprise one or more of the following materials: wood, plastics, or other synthetic materials such as plastic, acrylic, nylon, nylon blends, polyurethane, carbon fibers, metal, anodized metal, cellulose acetate, cellulose propionate, monel, beryllium, flexon, polycarbonate, and the like.

In other embodiments, the middle layers and internal parts can comprise one or more of the following materials: acrylic, nylon, nylon blends, polyurethane, carbon fibers, wood, monel, beryllium, flexon, polycarbonate, steel, stainless steel, brass, iron, copper, zinc, carbide, carbide alloys, aluminum, aluminum alloys, titanium, titanium alloys, nickel, lead, nickel alloys, gold, gold alloys, silver, silver alloys, or other hard or semi-hard metals of any sort.

In some embodiments, the scribe tools are held together by small screws, rivets, solder or welding. Screws and rivets are internal parts that may comprise the materials described above. In other embodiments, where components of the scribe tool comprise wood, plastics, or other non-metal materials, glue or other adhesives known in the art may be used to hold parts together.

In some embodiments, the scribe tool employs magnets. Magnets are well-known in the art. Non-limiting examples of magnets for use in the invention comprise ferromagnetic and ferromagnetic materials such as ores such as iron ore (magnetite or lodestone), cobalt, and nickel. In other embodiments, rare earth magnets are used. Non-limiting examples include neodymium, gadolinium, sysprosium, samarium-cobalt, neodymium-iron-boron, and the like. In yet further embodiments, the magnets comprise composite materials. Non-limiting examples include ceramic, ferrite, and alnico magnets. In another embodiment, scribe tool employs one or more electromagnets. In further embodiments, the scribe tool employs 1, 2, 3, 4, 5, 6, 7, 8, 9, 10, 11-15, 16-20, 21-30 or more than 30 magnets.

The scribe tool's magnet(s) may double as a stud finder. In one embodiment, the scribe tool's magnets locate metallic studs or screw heads that hold sheetrock to studs. In another embodiment, the magnet is amplified or made larger to increase the sensitivity of the tool for finding studs. In another embodiment, the tool has one or more additional magnets that increase the sensitivity of the tool for finding studs. In another embodiment, the magnets in the tool are used to attach it to magnetic or metal parts on aprons, bags, or other surfaces commonly found in construction sites, shops, or manufacturing facilities.

In some embodiments, the scribe tool utilizes blades. Blade materials are well-known in the art. Non-limiting examples of materials for use in the blades of the invention include stainless steel, tool steel, alloy steel, carbide, carbide alloys, titanium alloys, ceramics, obsidian, and plastics. In other embodiments, the scribe tool utilizes blades made from materials that are attracted to magnets that assist friction in holding the blades in their openings. Metals that are attracted to magnetism are well known in the art. Non-limiting examples include carbonized steel, iron, nickel, cobalt, magnetic alloys and the like. In another embodiment, the blades comprise two or more of the blade materials described herein.

The scribe tools described herein may employ multiple types of marking structures. Marking structures are well-known in the art. A non-limiting list of marking structures include blades, pens, pencils, lead, graphite, markers, crayons, chalk, charcoal, paint and the like. In a preferred embodiment, blades are used for scribing and cut in one direction. In another preferred embodiment, blades are used for scribing and cut in two directions.

The invention contemplates that, in some embodiments, the blades or other marking structures may be stowed within the body of the tool. In one embodiment, a blade can be reversed into the opening for safety and stowage. In another embodiment, a pen can be reversed and have a safe storage opening. In other embodiments, the blade or marking structure may be folded into the body using a hinge. Hinges are well-known in the art and may be selected from the group consisting of case hinges, spring hinges, box hinges, stop hinges, rivet hinges, double jointed hinges, and ball in joint hinges. In another embodiment, the blade or marking structure may be retracted into the body. The fold and retraction embodiments are particularly suited to multi-offset scribe tools that comprise a plurality of marking structures.

In a preferred embodiment, magnets hold the scribing blades securely in place in both cutting and safety positions. In a more preferred embodiment, the magnets may conveniently double as a stud finder or allow easy storage on magnetic work aprons. In another embodiment, blades or other marking structures are held in place using friction. In a most preferred embodiment, the blade or marking structure is held into place by using both a magnet and friction. In another embodiment, the blades or marking structure may be removed by hand and placed in a different opening to achieve a different offset.

In order that the invention described herein may be more fully understood, the following examples are set forth. It should be understood that these examples are for illustrative purposes only and are not to be construed as limiting this invention in any manner.

EXAMPLE 1

Multi-Offset Scribe Tool

Figure 5:
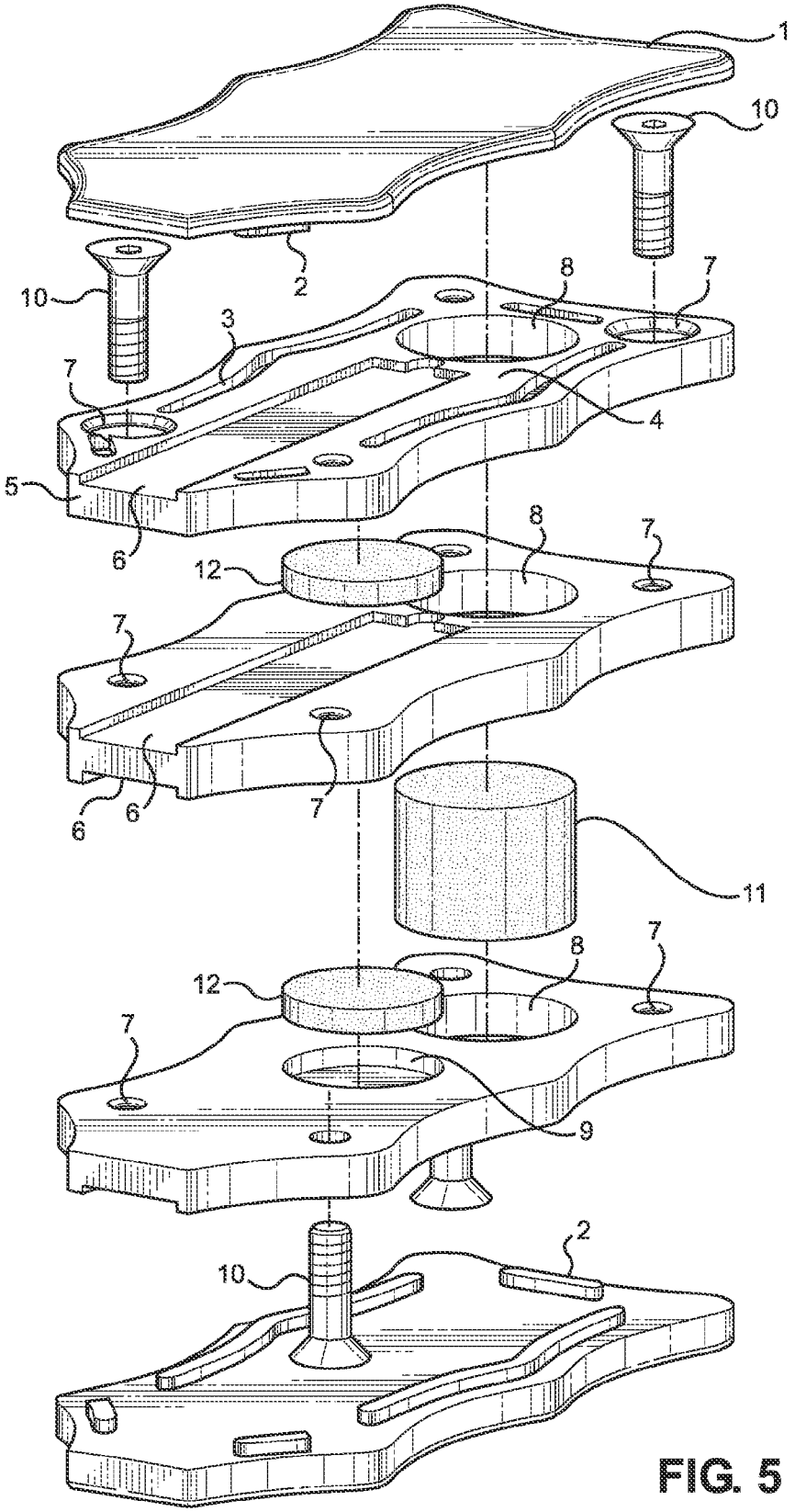
FIG. 5. Exploded view of the multi-offset scribe tool of FIG. 1. See Example 1.
Figure 6A:
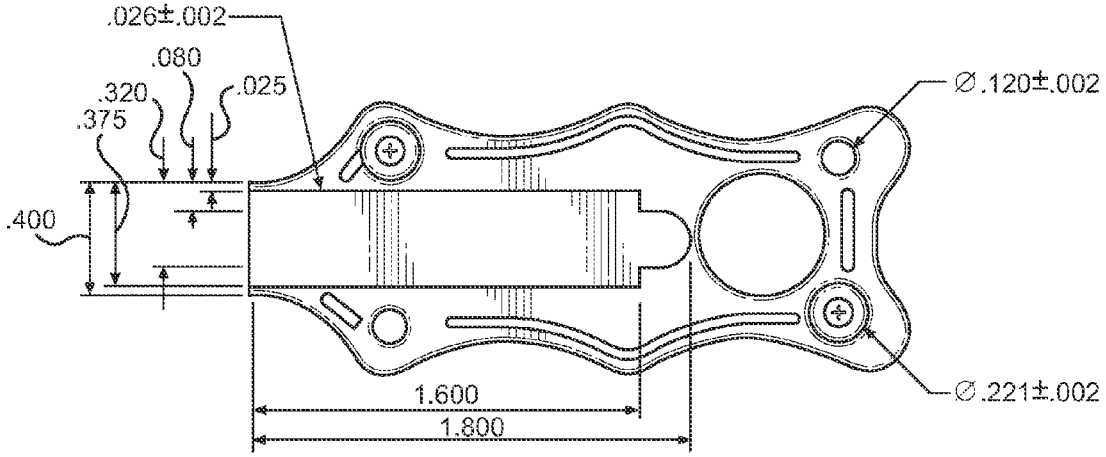
FIGS. 6A and 6C depict middle layers 1 and 3, respectively. These layers are identical but arranged in opposite orientations. Thus, 6C depicts the top of the third middle layer and is the same as the bottom of the first middle layer (6A) which cannot be seen. Likewise, 6A depicts the top of the first middle layer and is the same as the bottom of the third middle layer (6C) which cannot be seen. 6B shows the top of the second middle layer which is identical on both sides. The measurements are those that were used in the construction of the multi-offset scribe tool described in Example 1. 6D depicts the stacking of the three middle layers and the positioning of one of the screws within the body of the assembled multi-offset scribe tool.
Figure 6B:
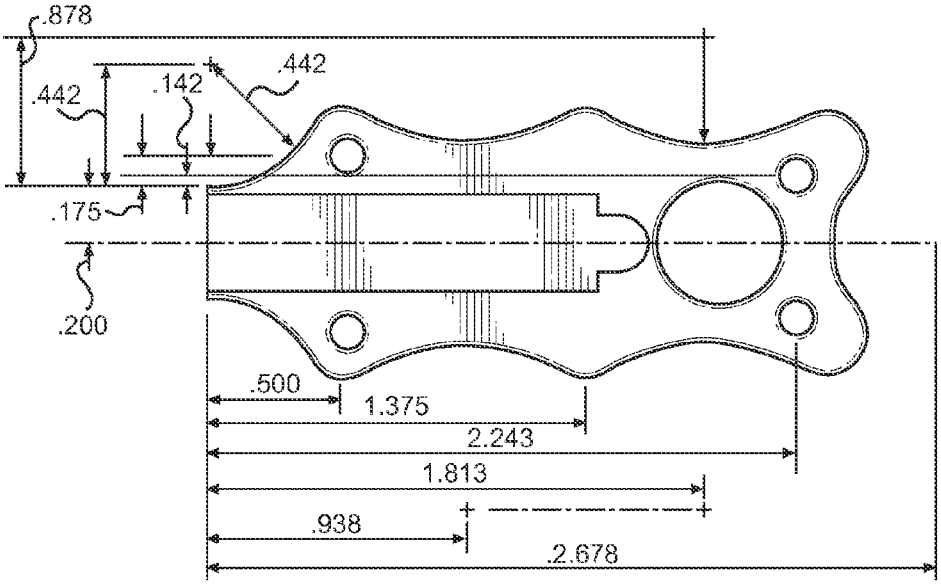
FIG. 6. Perspective views of the middle layers from the multi-offset scribe tool of FIG. 1.
Figure 6C:
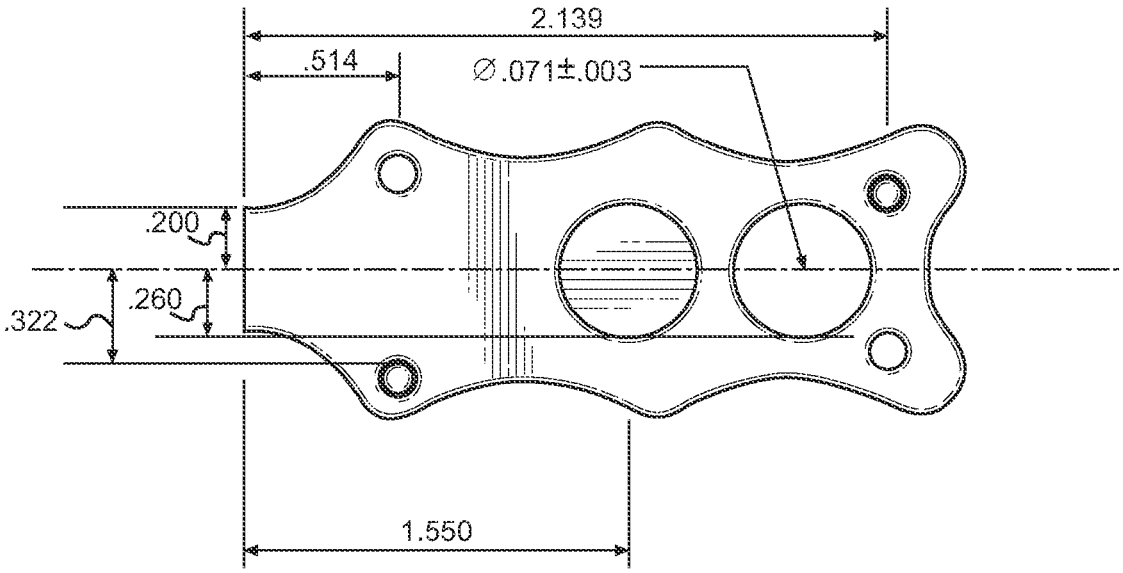
Figure 6D:
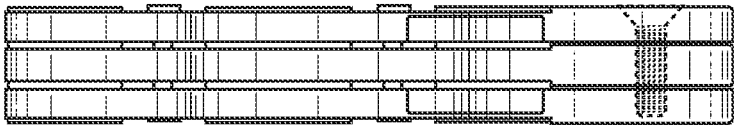
Figure 7:
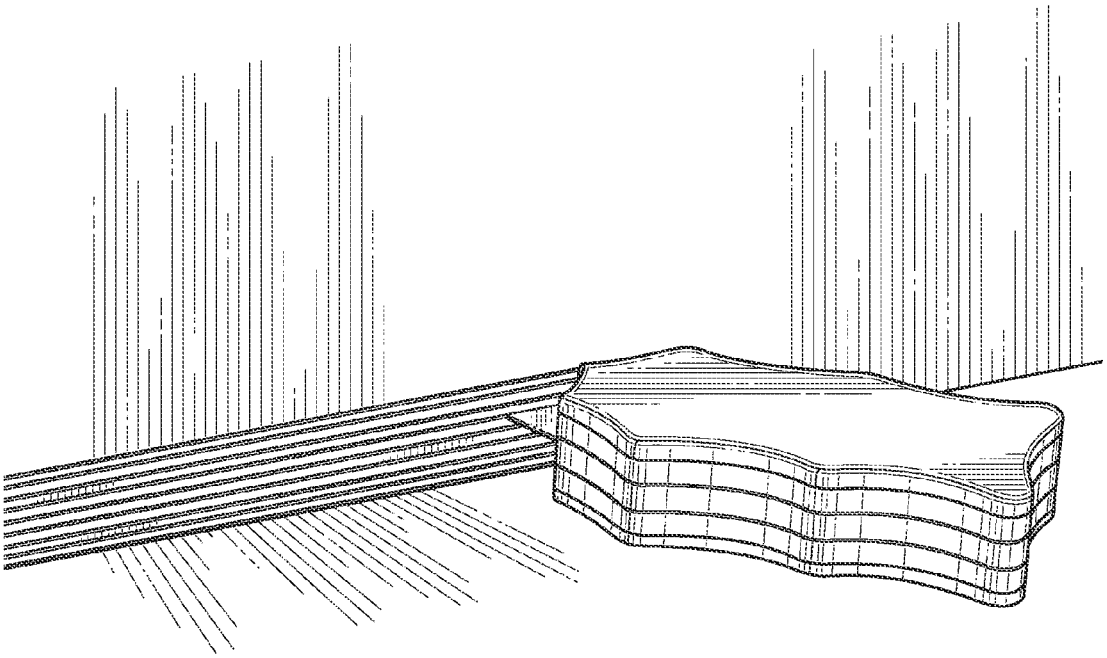
FIG. 7. Use of the multi-offset scribe tool from FIG. 1 to scribe a line. The reference and target surfaces are shown.

A scribe tool for holding scribe blades was constructed as shown in FIGS. 1, 5, and 6. The scribe tool in this example had five (5) layers. See FIG. 5. Layer 1 formed a first flat surface 1 wherein the flat surface was made of plastic. Snap protrusions 2 opposite the flat surface on layer 1 fitted into snap channels 3 in the "top" of layer 2 (4). Layers 2-4 comprised the end surfaces 5. Layer 2 was machined with a blade opening 6, snap channels 3, screw holes 7, through holes 8 for magnet type A 11 and on the back side a machined depression 9 to house magnet type B 12. Layer 3 was the center layer. It had a blade opening 6 machined on both sides and secured through the screw holes 7 with screws 10. The screw holes in layers 2 and 4 (identical parts) were arranged cattycorner from each other with two countersunk through holes and two threaded holes. This was so layers 2 and 4 were identical to each other. Layer 3 is identical on both sides. The top view of layers 2 and 3 are shown in FIGS. 6A and 6B, respectively. The top view of layer 4 is identical to the bottom view of layer 2 and is shown in FIG. 6C. The dimensions of the scribe tool are shown. See FIG. 6.

Layer 5 was identical to layer 1 (it had a second flat surface and snap protrusions on the inner surface) except that it was 1/16 inch thicker than layer 1. See FIG. 5. Layers 1 and 5 were made with different thicknesses so that when the scribe tool was fully assembled (FIG. 2), eight (8) different offsets were available depending on which flat surface is facing down. The offset of the blade held between layers 1 and 2 when the tool was placed on the first flat surface was 1/16 inch. Likewise, when the scribe tool was fully assembled, the offset of the blade or marking structure held between layers 4 and 5 when the tool was placed on the second flat surface was 1/8 inch. Each opening was offset in the assemble scribe tool 1/8 inch from the nearest opening(s). Thus, the offsets, when resting on the first flat surface were 1/16, 3/16, 5/16 and 7/16 inches; the offsets, when resting on the second flat surface, were 1/8, 1/4, 3/8 and 1/2 inches.

EXAMPLE 2

Method for Scribing Using Multi-Offset Scribe Tool

The scribe tool of Example 1 was used to scribe a reference surface onto a target surface of an object as follows. First, the amount of material to remove was determined. In practice, this may be the largest gap, however some situations require more and sometimes less material to be removed. The size of the offset was determined by systematically changing slots and sides until the right slot and side was determined. Alternatively, the appropriate size could be measured against the material to be removed. Once the size was determined, the blade was placed in the appropriate opening. Second, the scribe was cut. While applying downward pressure to the tool, the blade was lightly pulled against the target surface making the preliminary cutting mark. Continued cutting over the initial scribe was done until a deep score line was attained. The deeper the scribe, the easier it is to remove excess material. While scribing, the tool remained firmly in place and the accuracy monitored by sight and feel. A blade can ride up a grain if one is not careful or tries to cut too deeply too quickly. Third, after the scribe was cut, the scribe was returned to a safety position. The blade was carefully removed from the tool and returned to the opening with the sharp side pointing inwards (safety position). Fourth, the excess material along the scribed line was removed using methods well-known in the art.

In some embodiments, sawdust or talcum powder may be applied to the scribe line to make it easier to see prior to material removal. In an alternative embodiment, the scribe tools use ink, pencils, paint, chalk, and the like as a transcriber. Here, only one pass is generally needed. Non-razor embodiments are useful on rough surfaces or in situations where colorized scores are beneficial, for instance, in grains that resemble the cut.

All publications and patent documents disclosed or referred to herein are incorporated by reference in their entirety. The foregoing description has been presented only for purposes of illustration and description. This description is not intended to limit the invention to the precise form disclosed. It is intended that the scope of the invention be defined by the claims appended hereto.

What is claimed:

1. A multiple offset scribe tool comprising:

a. a marking structure;

b. a body having a first flat surface and a second flat surface on opposite sides of said body;

c. a first end surface;

d. a first opening for housing said marking structure in either a use or a safety position, a second opening for housing said marking structure in either a use or a safety position, a third opening for housing said marking structure in either a use or a safety position;

wherein said first, second, and third openings are positioned on said end surface between said first and second flat surfaces to enable said marking structure to extend from said end surface when in said use position;

wherein said first opening is offset a first measure increment from a first plane formed by said first flat surface;

wherein said third opening is offset a second measure increment from a second plane formed by said second flat surface;

wherein said first and second measure increments are different;

wherein said third opening lies between said first and second openings on said first end surface and is about equidistant from said first and second openings by a third measure increment;

wherein said scribe tool is enabled to scribe a line on a target surface that has a distance from a reference surface that is selected from six different combined units of measure; and wherein said combined units of measure result from said marking structure being housed in any of said three openings and when said first or second flat surface is positioned on said reference surface.

2. The scribe tool of claim 1, further comprising a fourth opening between said first and second openings on said end surface wherein said openings are offset from its immediately-neighboring opening by about said third measure increment and wherein said scribe tool is enabled to scribe a line on a target surface that has a distance from said reference surface that is selected from eight different combined units of measure.

3. The scribe tool of claim 2, further comprising a plurality of middle layers within said body of said tool that define said measure increments.

4. The scribe tool of claim 3, wherein said body comprises five layers having two flat surfaces and three middle layers and having four openings.

5. The scribe tool of claim 1, wherein said body is solid.

6. The scribe tool of claim 1, further comprising a second end surface having additional openings that are offset by additional measure increments from said planes formed by said first and second flat surfaces.

7. The scribe tool of claim 1, wherein said measure increments are English measure increments.

8. The scribe tool of claim 7, wherein one or more of said measure increments are ⅛ inch increments minus the thickness of the marking structure.

9. The scribe tool of claim 7, wherein one or more of said offsets are 1/16 inch increments minus the thickness of the marking structure.

10. The scribe tool of claim 1, wherein said offsets are metric measure increments.

11. The scribe tool of claim 10, wherein one or more of said offsets are 2 mm increments minus the thickness of the marking structure.

12. The scribe tool of claim 10, wherein one or more of said offsets are 3 mm increments minus the thickness of the marking structure.

13. The scribe tool of claim 10, wherein one or more of said offsets are 4 mm increments minus the thickness of the marking structure.

14. The scribe tool of claim 10, wherein one or more of said offsets are 5 mm increments minus the thickness of the marking structure.

15. The scribe tool of claim 1 comprising a first group of offsets having English measure increments and a second group of offsets having metric measure increments.

16. The scribe tool of claim 1, wherein the approximate shape of said body is a polygon.

17. The scribe tool of claim 16, wherein said polygon is selected from the group consisting of a triangle, quadrilateral, pentagon, hexagon, septagon, octagon, nonagon, decagon, dodecagon.

18. The scribe tool of claim 1, wherein the approximate shape of said body is round or ovoid.

19. The scribe tool of claim 1, wherein the approximate shape of said body comprises both angled and curved lines.

20. The scribe tool of claim 1, wherein one or more sides of said body are ribbed.

21. The scribe tool of claim 1, wherein one or more of said flat surfaces comprise a material selected from the group consisting of wood, plastic, acrylic, nylon, nylon blend, polyurethane, carbon fiber, metal, anodized metal, cellulose acetate, cellulose propionate, monel, beryllium, flexon, and polycarbonate.

22. The scribe tool of claim 1, wherein one or more middle layers comprise a material selected from the group consisting of a hard metal, a semi-hard metal, acrylic, nylon, nylon blend, polyurethane, carbon fiber, zinc, wood, monel, beryllium, flexon, polycarbonate, steel, stainless steel, brass, iron, copper, zinc, aluminum, aluminum alloy, carbide, titanium, titanium alloy, nickel, nickel alloy, lead, gold, gold alloy, silver, and silver alloy.

23. The scribe tool of claim 1, wherein said marking structure is a blade comprised of a material selected from the group consisting of stainless steel, tool steel, alloy steel, carbide, titanium, titanium alloys, ceramics, obsidian, plastics, carbonized steel, iron, nickel, cobalt, magnetic alloys, and a combination thereof.

24. The scribe tool of claim 1, further comprising one or more magnets embedded within said body.

25. The scribe tool of claim 1, wherein said marking structure is selected from the group consisting of blades, pens, pencils, lead, graphite, markers, crayons, chalk, charcoal, and paint.

26. The scribe tool of claim 1, wherein said marking structure is put in said safety position by reversing it into said opening, folding it into said body, or retracting it into said body.

* * * * *